US007980493B2

(12) United States Patent
Nakano et al.

(10) Patent No.: US 7,980,493 B2
(45) Date of Patent: Jul. 19, 2011

(54) ELECTROSTATIC ATOMIZER

(75) Inventors: Sumiaki Nakano, Yamatokoriyama (JP); Akihide Sugawa, Hikone (JP); Toshihisa Hirai, Hikone (JP); Kishiko Hirai, legal representative, Hikone (JP); Fumio Mihara, Kyoto (JP); Yasunori Matsui, Hirakata (JP)

(73) Assignee: Panasonic Electric Works Co., Ltd., Kadoma-shi (JP)

( * ) Notice: Subject to any disclaimer, the term of this patent is extended or adjusted under 35 U.S.C. 154(b) by 247 days.

(21) Appl. No.: 11/988,630

(22) PCT Filed: Jul. 14, 2006

(86) PCT No.: PCT/JP2006/314100

§ 371 (c)(1),
(2), (4) Date: Jan. 11, 2008

(87) PCT Pub. No.: WO2007/010872

PCT Pub. Date: Jan. 25, 2007

(65) Prior Publication Data

US 2009/0121050 A1 May 14, 2009

(30) Foreign Application Priority Data

Jul. 15, 2005 (JP) ..... 2005-207578
Oct. 26, 2005 (JP) ..... 2005-312008

(51) Int. Cl.
*B05B 5/00* (2006.01)
*B05B 5/053* (2006.01)
*F23D 11/32* (2006.01)

(52) U.S. Cl. ..... 239/695; 239/128; 239/690.1; 361/228; 361/226; 361/225; 62/129; 62/135

(58) Field of Classification Search ..... 239/690–708, 239/128, 423, 433, 397.5; 96/27, 28, 53, 96/65, 71; 261/107, 78.2, 140.1, DIG. 16.65; 361/228; 700/299; 62/93, 272
See application file for complete search history.

(56) References Cited

U.S. PATENT DOCUMENTS 5,337,963 A 8/1994 Noakes et al.
6,610,417 B2 * 8/2003 Andresakis et al. ..... 428/607

(Continued)

FOREIGN PATENT DOCUMENTS

EP 1 905 516 A1 4/2008

(Continued)

OTHER PUBLICATIONS

Supplementary European Search Report mailed Apr. 27, 2009, issued on the European application No. 06781125.7.

(Continued)

*Primary Examiner* — Dinh Q Nquyen
*Assistant Examiner* — Justin Jonaitis
(74) *Attorney, Agent, or Firm* — Edwards Angell Palmer & Dodge LLP

(57) ABSTRACT

An electrostatic atomizer equipped with an electrostatic atomization pole having superior resistance to migration. The atomizer includes an electrostatic atomization pole, a liquid supply mechanism that supplies the pole with liquid, and a power supply that supplies the pole with high voltage to electrostatically atomize the liquid held on the pole. A coating is formed on the surface of the pole, and the coating is formed of simple metal or alloy, which displays resistance to migration.

13 Claims, 4 Drawing Sheets

U.S. PATENT DOCUMENTS

| | | | | |
|---|---|---|---|---|
| 7,494,532 | B2 * | 2/2009 | Azukizawa et al. | 96/27 |
| 7,567,420 | B2 * | 7/2009 | Kobayashi et al. | 361/228 |
| 2003/0068517 | A1 | 4/2003 | Andresakis et al. | |
| 2009/0001200 | A1 * | 1/2009 | Imahori et al. | 239/700 |
| 2009/0121050 | A1 | 5/2009 | Nakano et al. | |

FOREIGN PATENT DOCUMENTS

| | | | |
|---|---|---|---|
| JP | 3260150 | | 12/1993 |
| JP | 07-326701 | | 12/1995 |
| JP | 08-017673 | | 1/1996 |
| JP | 2004-200644 | | 7/2004 |
| JP | 2004-358362 | | 12/2004 |
| JP | 2005-131549 | | 5/2005 |
| JP | 2005131549 | A * | 5/2005 |
| JP | 2005-529448 | | 9/2005 |
| JP | 2005-296753 | | 10/2005 |
| JP | 2006-029663 | A | 2/2006 |
| WO | WO-01/71311 | | 9/2001 |
| WO | WO 2005042171 | A1 * | 5/2005 |
| WO | WO-2007/010872 | A1 | 1/2007 |

OTHER PUBLICATIONS

Japanese Official Action dated Dec. 22, 2009 issued in Japanese Patent Application No. 2005-312008.

* cited by examiner

ELECTROSTATIC ATOMIZER

BACKGROUND OF THE INVENTION

1. Field of the Invention

The invention relates generally to electrostatic atomizers and more particularly to an electrostatic atomizer that employs electrostatic atomization of water to generate mist of charged fine particles in the order of nanometer in size.

2. Description of the Related Art

Such sort of electrostatic atomizer is seen in, for example, the patent document of Japanese Patent Number 3260150 (European Patent Publication Number 0 486 198 A1 or U.S. Pat. No. 5,337,963). A prior art device described in the document comprises a cartridge for storage of liquid suitable for electrostatic spraying, and a high voltage means for applying electrostatic potential to the liquid. The cartridge includes a capillary structure that extends into the interior of the cartridge so as to feed liquid by capillary action from the cartridge to a spraying outlet at a tip of the capillary structure. The cartridge also includes a means for providing an electrically conductive path to allow the application of an electrostatic charge to the liquid. When the high voltage means applies the potential to the liquid at the mouth of the spraying outlet, a potential gradient is developed between innermost and outermost peripheral surfaces of the mouth, and draws the liquid across an end face of the spraying outlet towards the outermost peripheral surface. Thereby, the liquid is projected electrostatically as an array of ligaments which form a halo around the mouth. In another configuration, the device is further provided with an electrode connected to a low potential such as earth.

However, because the high voltage means applies electrostatic potential within the range from 10 kV to 25 kV to an electrical contact in the cartridge, there is an issue that (stress) migration occurs at the electrical contact.

SUMMARY OF THE INVENTION

It is therefore an object of the present invention to improve migration-proof of an electrostatic atomization pole that is an electrode.

An electrostatic atomizer of the present invention comprises: an electrostatic atomization pole that is an electrode; a liquid supply means that supplies the pole with liquid; and a voltage supply means that supplies the pole with high voltage to electrostatically atomize the liquid held on the pole. According to one aspect of the invention, a coating formed on the surface of the pole is provided. The coating is formed of simple metal or alloy, which displays resistance to migration. Preferably, the resistance is superior to that of the pole. Thus, the coating is formed on the surface of the pole and thereby the migration resistance of the electrostatic atomization pole can be improved. As a result, electrostatic atomizers having superior durability (long lifetime) can be provided.

The pole may be a plug formed of simple metal or alloy having high thermal conductivity and high electrical conductivity. In this case, the liquid supply means cools the plug to supply the plug with water as the liquid through dew formation on the surface of the plug. According to this configuration, since a means for storage of the liquid is omitted, a compact electrostatic atomizer can be provided.

The pole may be a nozzle having at least one hole at its tip. In this case, the liquid supply means supplies the liquid into the nozzle. According to this configuration, electrostatic atomization of desired liquid is possible.

Preferably, the pole is formed of Cu or Cu alloy, and the coating is formed of Ni or Ni alloy. According to this structure, the migration resistance of the electrostatic atomization pole can be improved. Also in case that the pole is the plug, the plug has superior thermal conductivity and therefore water can be secured through dew formation and cost reduction is possible.

It is also preferable that the simple metal or the alloy forming the coating further displays resistance to acid and alkali. According to this structure, acid and alkali resistance of the electrostatic atomization pole can be improved.

Preferably, the simple metal or the alloy forming the coating is Au, Pd, Pt or Cr, or alloy containing Au, Pd, Pt or Cr as fundamental material, respectively. According to this structure, it is possible to improve resistance to migration, wear, acid and alkali of the electrostatic atomization pole.

It is preferable that the coating further has high wettability. According to this configuration, formation of a Taylor cone becomes easy.

Preferably, thickness of the coating on the tip region of the pole is thicker than that on the remaining region of the pole. According to this structure, it is possible to improve migration resistance in the tip region where migration is liable to be generated.

BRIEF DESCRIPTION OF THE DRAWINGS

Exemplary embodiments of the invention will now be described in further details. Other features and advantages of the present invention will become better understood with regard to the following detailed description and accompanying drawings where.

DETAILED DESCRIPTION OF EXEMPLARY EMBODIMENTS

Figure 1A:
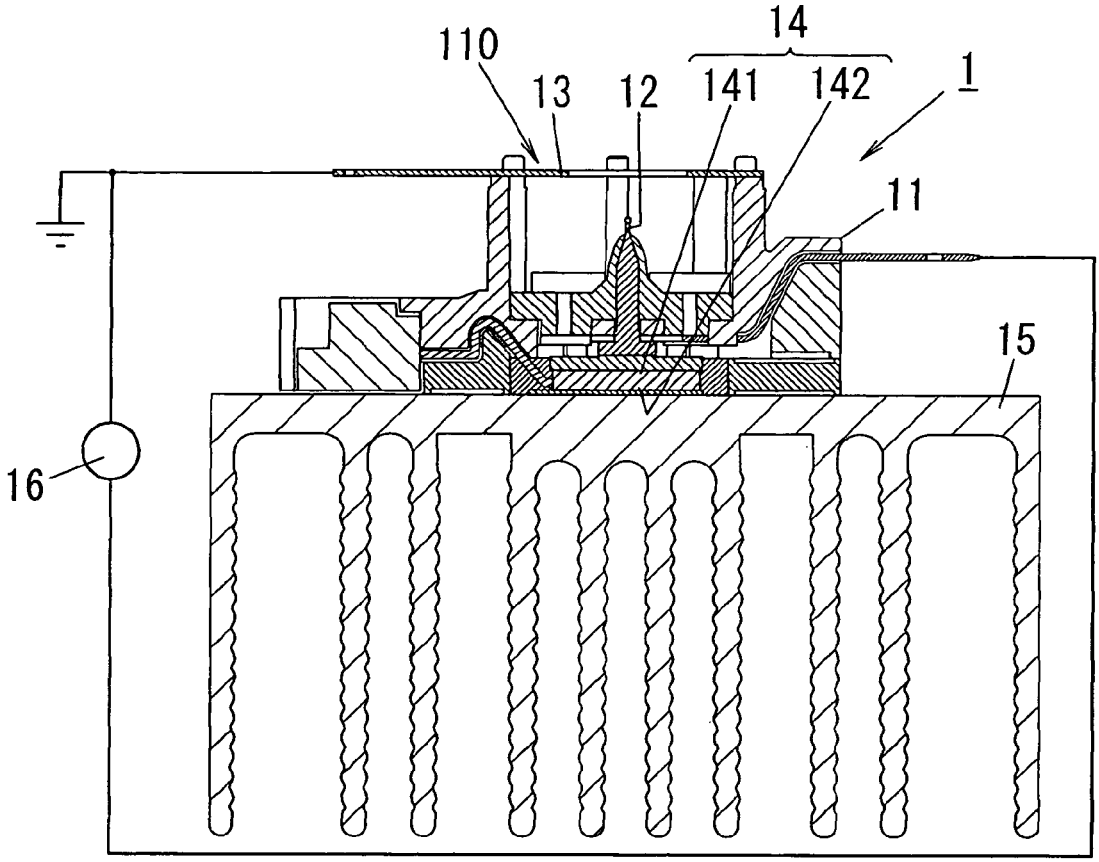
FIG. 1A is a sectional view of a first embodiment according to the present invention.
Figure 1B:
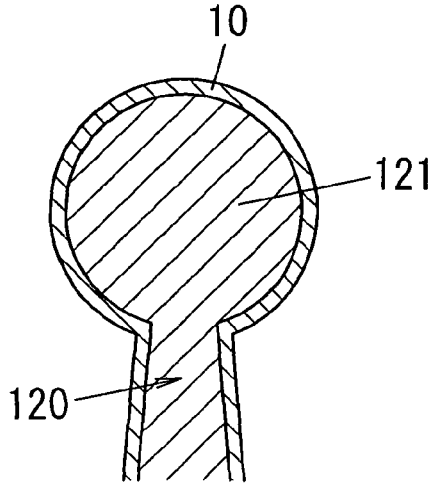
FIG. 1B is a sectional view of the tip of a plug in FIG. 1A.

FIG. 1A is a sectional view of a first embodiment according to the present invention (i.e., an electrostatic atomizer 1), and FIG. 1B is a sectional view of the tip of a plug provided for the atomizer 1. The atomizer 1 comprises a housing 11, an electrostatic atomization pole 12, a counter electrode 13, a liquid supply mechanism 14, a radiator 15 and a power supply 16.

The housing 11 is formed of, for example, insulation material, and has a cavity 110. The electrostatic atomization pole 12 is a T-shaped electrode plug having a teardrop-shaped tip 121, and is inserted into and fixed at a hole of the bottom in the cavity 110 with the tip 121 forward along an axial direction of the cavity 110. The counter electrode 13 is located on the opening of the cavity 110 in front of the pole 12.

The liquid supply mechanism 14 is a Peltier device with a cooling portion 141 and a heat-radiating portion 142. The portions 141 and 142 are thermally connected to the base end of the electrostatic atomization pole 12 and the base end of the radiator 15, respectively. The device cools the electrostatic atomization pole 12 through the cooling portion 141 to supply the pole 12 with water as the liquid through dew formation on the surface of the pole 12. That is, moisture in the air is supplied as the water to the surface of the tip 121 of the pole 12.

The radiator 15 is, for example, a heat-radiating fin, and is attached to the back of the housing 11 to be thermally connected to the liquid supply mechanism 14 (heat-radiating portion 142).

The power supply 16 is a high voltage generator, and applies high voltage across the pole 12 and the electrode 13 to electrostatically atomize the liquid held on the pole 12. A positive output terminal of the generator is connected to Ground and the electrode 13, while its negative output terminal is connected to the pole 12. When high voltage is applied across the pole 12 and the electrode 13, a negative electronic charge concentrates on the pole 12 (negative electrode), and also water held on the tip 121 of the pole 12 rises like a cone to form a Taylor cone. When the negative electronic charge concentrates on the tip of the Taylor cone to become high density, repulsion in the high density of the electronic charge brings about Rayleigh splitting to split and scatter the Taylor cone shaped water. The power supply 16 repeats the Rayleigh splitting to realize electrostatic atomization.

Figure 2A:
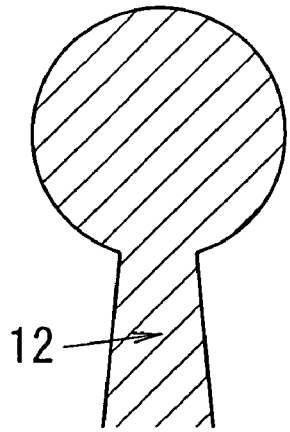
FIG. 2A is an explanatory diagram of migration.
Figure 2B:
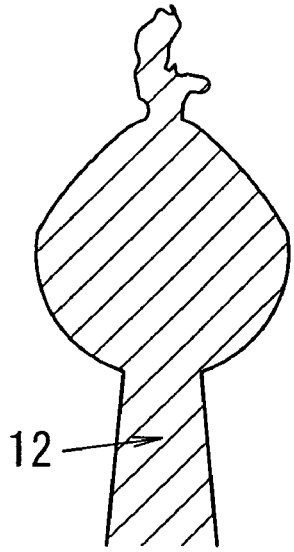
FIG. 2B is an explanatory diagram of migration.

As mentioned above, if the electrostatic atomization pole 12 holding the liquid on the surface of the tip 121 is repeatedly subjected to high voltage over a long period, the pole 12 has a tendency to be transformed from a normal shape as shown in FIG. 2A into another shape as shown in FIG. 2B through migration. Thus, if the normal shape is transformed, the above Taylor cone is not normally formed and therefore the electrostatic atomizer 1 cannot normally operate.

Then, according to an aspect of the first embodiment, as shown in FIG. 1B, a coating 10 formed on the surface of the electrostatic atomization pole 12 is provided. First, the pole 12 itself is formed by cutting of Cu—Sn (brass material) with high thermal conductivity and high electrical conductivity. Thereby, the pole 12 can be cooled efficiently and also the pole 12 can be easily discharged. But the material of the pole 12 is not limited to the brass material, the material may be simple metal (e.g., Cu or the like) or alloy (e.g., Cu alloy except the brass material, or the like), having high thermal conductivity and high electrical conductivity.

After surface treatment of the electrostatic atomization pole 12, the coating 10 is formed on the surface of the pole 12. The coating 10 is formed of simple metal or alloy, which displays resistance to migration. The coating 10 in the first embodiment is a Ni plating layer having migration resistance that is superior to the brass material. For example, in case of non-electrolytic plating, the thickness of the coating 10 can be formed to the uniform thickness as shown in FIG. 1B. In order to prevent formation of pinhole defects, the thickness of the coating 10 is preferably equal to or more than 4 μm and, more preferably, about 20 μm including a margin. Incidentally, it is preferable to secure high wettability of the surface. Because wettability of the surface of the whole pole 12 including the coating 10 influences formation of the Taylor cone and low wettability prevents formation of appropriate Taylor cone to reduce electrostatic atomization efficiency.

Thus, by forming the coating 10 on the surface of the electrostatic atomization pole 12, the migration resistance of the pole 12 can be improved. Consequently, the electrostatic atomizer 1 having superior durability (long lifetime) can be provided.

Figure 3:
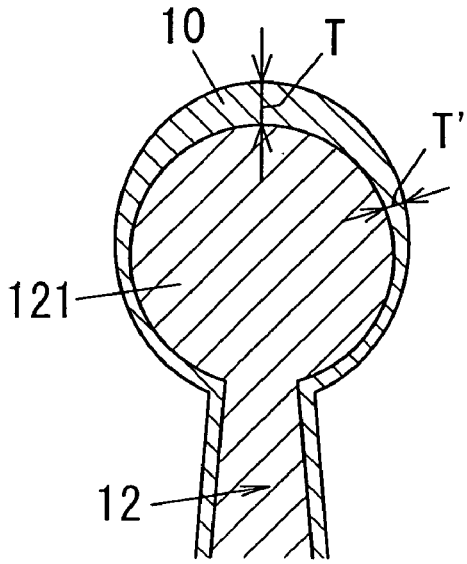
FIG. 3 is a sectional view of a modified embodiment.
Figure 4:
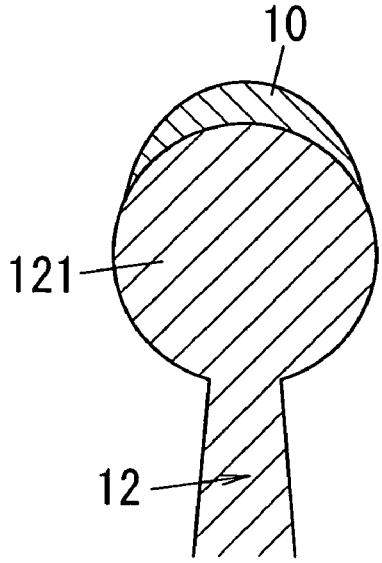
FIG. 4 is a sectional view of another modified embodiment.

In a modified embodiment, as shown in FIG. 3, the coating 10 is a Ni plating layer formed by electrolytic plating. This sort of layer has a tendency to become thicker in sharp part in general. Therefore, by employing this tendency, a thickness T of the coating 10 on the top of the tip 121 can be made thicker than thickness T' of the coating 10 on the other part. Accordingly, the thicker part of the coating 10 can preferably protect the top of the tip 121 where migration can easily occur. Also in case of the electrolytic plating, the production cost can be held down and productivity can be improved. Being not limited to this, as shown in FIG. 4, the coating 10 may be formed only on the top of the tip 121 where migration easily occurs and also a Taylor cone is formed.

In another modified embodiment, the electrostatic atomizer 1 does not comprise the counter electrode 13, and the power supply 16 supplies the electrostatic atomization pole 12 with high voltage with respect to ground potential.

Figure 5A:
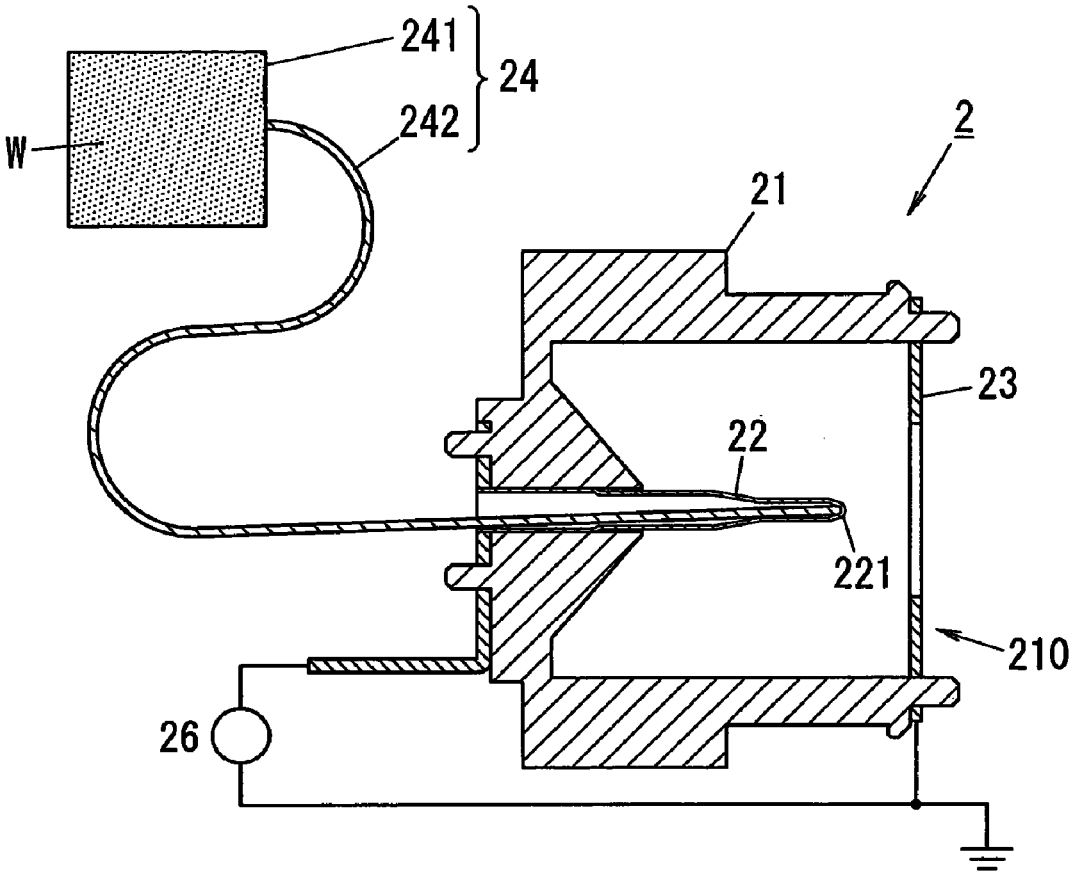
FIG. 5A is a sectional view of a second embodiment according to the present invention.
Figure 5B:
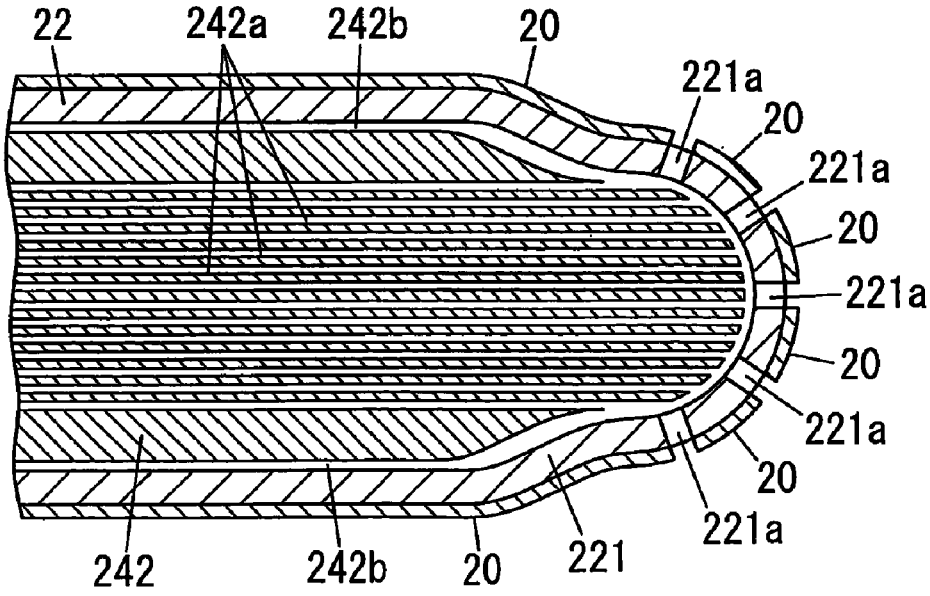
FIG. 5B is a sectional view of the tip of a nozzle in FIG. 5A.

FIG. 6A is a sectional view of a second embodiment according to the present invention (i.e., an electrostatic atomizer 2), and FIG. 5B is a sectional view of the tip of a nozzle provided for the atomizer 2. The atomizer 2 comprises a housing 21, an electrostatic atomization pole 22, a counter electrode 23, a liquid supply mechanism 24 and a power supply 26.

The housing 21 is formed of, for example, insulation material, and has a cavity 210. The electrostatic atomization pole 22 is an arch-shaped hollow electrode nozzle having holes (221*a*, . . . ) at its tip 221, and is inserted into and fixed at a hole of the bottom in the cavity 210 with the tip 221 forward along an axial direction of the cavity 210. The counter electrode 23 is located on the opening of the cavity 210 in front of the pole 22.

The liquid supply mechanism 24 is formed of a liquid storage portion 241 for storing liquid (e.g., water W) and a liquid supply portion 242 for supplying the liquid into the pole 22. For example, the liquid supply portion 242 has capillary tubes (242*a*, . . . ) that transport liquid by capillary action, and transports the liquid in the portion 241 to the inner surface of the tip 221 of the pole 22 through the capillary tubes as well as a gap 242*b* between the pole 22 and the portion 242. However, being not limited to this, the liquid supply portion 242 may be formed of porous material having pores for transporting liquid by capillary action.

The power supply 26 is a high voltage generator, and applies high voltage across the pole 22 and the electrode 23 to electrostatically atomize the liquid held on the pole 22 like the power supply 16 of the first embodiment. In the second embodiment, the liquid transported to the inner surface of the tip 221 moves to the outer surface of the tip 221 via the holes (221*a*, . . . ) and then is atomized electrostatically.

According to an aspect of the second embodiment, as shown in FIG. 5B, a coating 20 formed on the surface of the electrostatic atomization pole 22 is provided. The pole 22 itself is formed of, for example, SUS or the like, while the coating 20 is formed of metal (e.g., Ni or Ni alloy) having migration-proof that is superior to the pole 22. However, not limited to this, the coating 20 may be further formed on the inner surface of the pole 22 and/or the inner periphery of each hole 221*a*.

Thus, by forming the coating 20 on the surface of the electrostatic atomization pole 22, the migration-proof of the pole 22 can be improved. Consequently, the electrostatic atomizer 2 having superior durability (long lifetime) can be provided.

Figure 6:
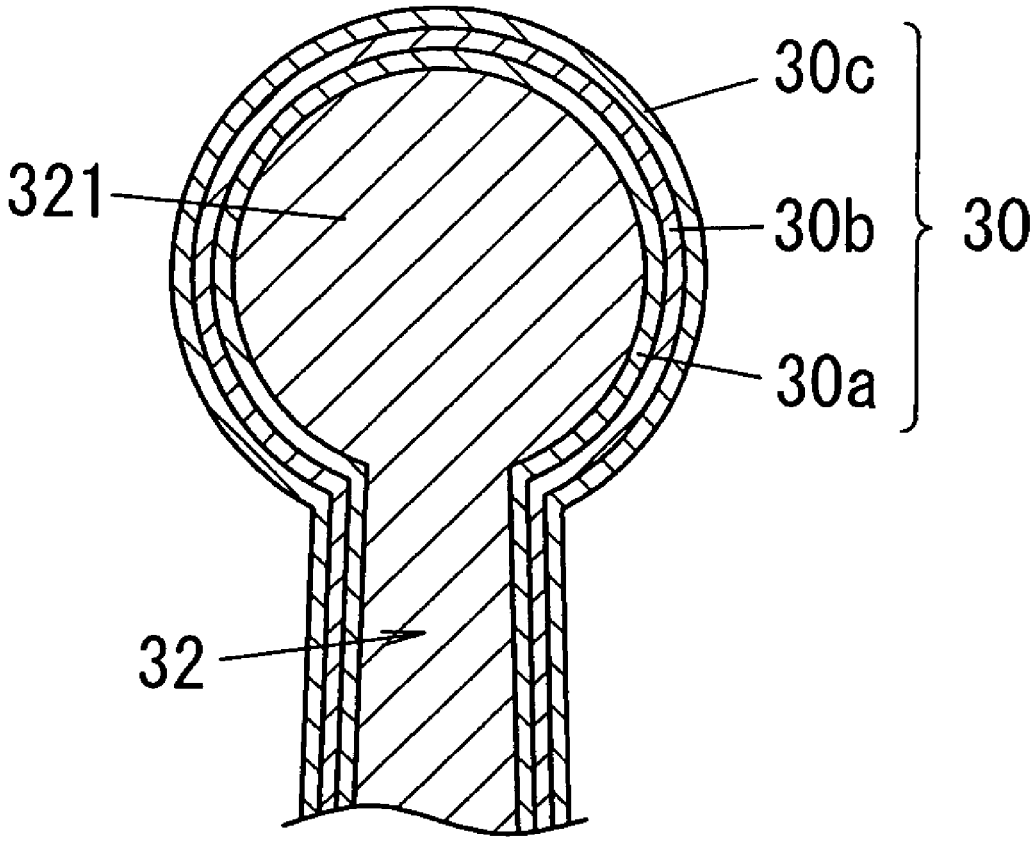
FIG. 6 is a sectional view of the tip of a plug in a third embodiment according to the present invention.

FIG. 6 is a sectional view of the tip of a plug in a third embodiment according to the present invention. The third embodiment comprises a housing, an electrostatic atomization pole 32, a counter electrode, a liquid supply mechanism, a radiator and a power supply in the same way as those of the first embodiment. In addition, according to an aspect of the third embodiment there is provided a coating 30 that is formed on the surface of the electrostatic atomization pole 32 and has a particular structure that is different from those of the first and second embodiments.

The coating 30 has a three-layer structure formed by barrel plating (electroplating) in order to cope with water that is supplied from the liquid supply mechanism and may be acid or alkali besides neutral. Specifically, the coating 30 is constructed of a first layer 30*a* formed on the surface of the electrostatic atomization pole 32, a second layer 30*b* formed on the surface of the layer 30*a* and a third layer 30*c* formed on the surface of the layer 30*b*.

Though the first layer 30*a* is a Ni plating layer that is about 15 μm in thickness and displays migration-proof superior to the electrostatic atomization pole 32, the layer 30*a* is provided mainly to prevent Cu contained in the pole 32 and after-mentioned Au contained in the second and the third layers from diffusing mutually. On account of this, the thickness of the layer 30*a* requires at least equal to or more than 1 μm. Also in order to prevent formation of pinhole defects, the thickness is preferably equal to or more than 4 μm and more preferably about 15 μm including a margin.

The second layer 30*b* and the third layer 30*c* are provided mainly to improve migration-proof, wearproof, acidproof and alkaliproof. That is, the layer 30*b* is an Au plating layer that is about 7 μm in thickness, and the layer 30*c* is an Au plating layer that is about 3 μm in thickness and contains added Co. The Au contained in the layers 30*b* and 30*c* has superior migration-proof, wearproof, acidproof, alkaliproof and productivity (barrel plating possible), and raises those characteristics of the pole 32. In order to prevent formation of pinhole defects, the thickness of the layer 30*b* is preferably equal to or more than 4 μm and more preferably, about 7 μm, including a margin. The Au plating layer containing Co, i.e., the layer 30*c* has high wettability, and also has hardness raised up to about Hv (Vickers Hardness) 250 from about Hv 80 to protect the layer 30*c* itself from flaws. Although the coating 30 may have one Au plating layer that contains added Co instead of the layers 30*b* and 30*c*, the upper limit of thickness of the Au plating layer containing Co is about 3 μm, and therefore the coating 30 of the third embodiment will have the layer 30*b* without Co and gloss and the layer 30*c* with Co and gloss in addition to the layer 30*a*. Thereby, the thickness of the part of the Au plating layers can be increased.

A result of comparison test (continuous operation test) between a sample 1' corresponding to the electrostatic atomization pole 12 and a sample 3' corresponding to the electrostatic atomization pole 32 is now explained. The coating of the sample 1' consisted of only a Ni plating layer, and this layer was about 19 μm in thickness. The coating of the sample 3' consisted of a Ni plating layer that was about 1 μm in thickness, and an Au plating layer that was about 18 μm in thickness and did not contain Co. However, the coating of the sample 3' was not provided with a layer corresponding to the third layer 30*c*.

An electrostatic atomizer as shown in FIG. 1A was equipped with each of the samples 1' and 3' one after another, and each sample was continuously driven through the atomizer for about 100 hours. Then, the deterioration degree of each sample was measured, and the result of continuous operation test was obtained. In the result, deterioration was not detected from the sample 3', whereas deterioration (wear) was detected from the sample 1'. That is, the thickness of the Ni plating layer of the sample 1' decreased from about 19 μm to about 12 μm. From the result, it is understood that the Au plating layer has high migration resistance and high wear resistance. On the other hand, the Ni plating layer was able to prevent migration, but was not able to prevent the wear. The Ni plating layer has hardness about Hv 500 harder than hardness about Hv 80 of the Au plating layer, while the Ni plating layer has wear resistance and acid resistance that are inferior to the Au plating layer. Therefore, it is thought that the above deterioration of the sample 1' could not be caused by dynamic contact, friction and so on, and was wear caused by chemical corrosion.

Next, a result of acid resistance test for the sample 3' is explained. After the sample 3' was soaked in a solution of 10% $H_2SO_4$ at 95° C. for 10 hours, corrosion degree of the sample 3' was measured. In the result of this test, corrosion was not detected from the sample 3'.

Next, a result of alkali resistance test for the sample 3' is explained. After the sample 3' was soaked in a solution of 10% NaOH at 95° C. for 10 hours, corrosion degree of the sample 3' was measured. In the result of this test, corrosion was not detected from the sample 3'.

From each result of the above tests, it is understood that resistance to migration, wear, acid and alkali of an electrostatic atomization pole can all be improved by adding a coating containing an Au plating layer to the pole. Therefore, it is possible to improve not only the migration resistance of an electrostatic atomization pole but also its resistance to wear, acid and alkali by forming a coating including at least one such second layer in addition to such a first layer on the surface of the pole. As a result, electrostatic atomizers having more superior durability (long lifetime) can be provided. Also in case of the barrel plating, electrostatic atomizers with the coatings can be mass-produced at a low price and therefore the productivity is improved. Incidentally, the coating can be also applied to that of the second embodiment.

In the third embodiment, Au is employed in order to improve resistance to migration, wear, acid and alkali, but the coating of the present invention is not limited to Au and may include a layer formed of simple metal of, for example, Pd, Pt or Cr, or include a layer formed of, for example, Pd, Pt or Cr alloy. Also in this case, advantages similar to the third embodiment are obtained.

Although the present invention has been described with reference to certain preferred embodiments, numerous modifications and variations can be made by those skilled in the art without departing from the true spirit and scope of this invention.

The invention claimed is:

1. An Electrostatic Atomizer, comprising:

an electrostatic atomization pole comprising an electrode;

a liquid supply means for supplying the pole with liquid; and a voltage supply means for supplying the pole with high voltage to electrostatically atomize the liquid held on the pole, wherein a coating is formed on the surface of the pole, said coating being formed of simple metal or alloy, which displays a resistance to migration, wherein the pole consists of a plug formed of a simple metal or alloy having high thermal conductivity and high electrical conductivity, said plug having a tip, and the liquid supply means is configured to cool the plug to supply the plug with water as the liquid through dew formation on the surface of the plug, and wherein said coating prevents the transformation of the tip of the plug.

2. The electrostatic atomizer of claim 1, wherein the resistance of the coating is superior to that of the pole.

3. The electrostatic atomizer of claim 1, wherein the pole is formed of Cu or Cu alloy and the coating is formed of Ni or Ni alloy.

4. The electrostatic atomizer of claim 2, wherein the pole is formed of Cu or Cu alloy and the coating is formed of Ni or Ni alloy.

5. The electrostatic atomizer of claim 1, wherein the simple metal or the alloy forming the coating further displays resistance to acid and alkali.

6. The electrostatic atomizer of claim 2, wherein the simple metal or the alloy forming the coating further displays resistance to acid and alkali.

7. The electrostatic atomizer of claim 5, wherein the simple metal or the alloy forming the coating is Au, Pd, Pt or Cr, or alloy containing Au, Pd, Pt or Cr as fundamental material, respectively.

8. The electrostatic atomizer of claim 6, wherein the simple metal or the alloy forming the coating is Au, Pd, Pt or Cr, or alloy containing Au, Pd, Pt or Cr as fundamental material, respectively.

9. The electrostatic atomizer of claim 1, wherein the coating further has high wettability.

10. The electrostatic atomizer of claim 1, wherein thickness of the coating on the tip region of the pole is thicker than that on the remaining region of the pole.

11. The electrostatic atomizer of claim 9, wherein thickness of the coating on the tip region of the pole is thicker than that on the remaining region of the pole.

12. The electrostatic atomizer of claim 2, wherein the coating further has high wettability.

13. The electrostatic atomizer of claim 2, wherein thickness of the coating on the tip region of the pole is thicker than that on the remaining region of the pole.

* * * * *